United States Patent [19]

Novello

[11] 4,088,290

[45] May 9, 1978

[54] ARTIST'S MAULSTICK

[76] Inventor: Louis J. Novello, 15 Marjorie Dr., Suffern, N.Y. 10901

[21] Appl. No.: 765,018

[22] Filed: Feb. 2, 1977

[51] Int. Cl.[2] ..... B43L 15/00

[52] U.S. Cl. ..... 248/118.5; 33/80; 248/274

[58] Field of Search ..... 248/118, 118.1, 118.3, 248/118.5, 122, 408, 413, 274; 33/80; 35/26, 36, 37, 38

[56] References Cited

U.S. PATENT DOCUMENTS

| | | | |
|---|---|---|---|
| 289,700 | 12/1883 | Parker | 248/122 X |
| 679,003 | 7/1901 | McRay | 108/92 |
| 1,416,896 | 5/1922 | Simmons | 248/408 X |
| 1,887,924 | 11/1932 | Evans | 248/298 X |
| 2,002,676 | 5/1935 | Owens | 33/80 |
| 2,044,187 | 6/1936 | Schwartz | 248/413 |
| 2,172,178 | 9/1939 | Rosenberg | 248/118 |
| 2,496,276 | 2/1950 | Dolas | 248/118.3 |
| 2,672,111 | 3/1954 | Widrow | 33/80 X |
| 2,816,726 | 12/1957 | White | 248/298 X |
| 3,955,788 | 5/1976 | Delage | 248/298 X |

FOREIGN PATENT DOCUMENTS

| | | | |
|---|---|---|---|
| 579,058 | 7/1958 | Italy | 248/413 |
| 10,310 of | 1890 | United Kingdom | 33/80 |

*Primary Examiner*—Roy D. Frazier
*Assistant Examiner*—Rodney H. Bonck
*Attorney, Agent, or Firm*—Leo C. Krazinski

[57] ABSTRACT

A telescopic maulstick that can be extended and retracted, as required, and clamped to the sides of an artist's frame having end means for securing same thereto and means intermediate the ends for locking the maulstick in a clamped position. The maulstick can also be used in any free or clamped position at a satisfactory elevation above the surface of the artist's frame.

1 Claim, 10 Drawing Figures

ARTIST'S MAULSTICK

BACKGROUND OF THE INVENTION

1. Field of the Invention

The present invention relates to hand rests and, more particularly, to improved artists' maulsticks.

2. Description of Prior Art

Hand rests, particularly maulsticks, are well known. As indicated in U.S. Pat. No. 289,700, Dec. 4, 1883, the maul stick is of a fixed length with a slidable hand rest upon which the artist may support his operative hand while the artist's other hand holds one end of the maul stick. In U.S. Pat. No. 2,496,276, Feb. 7, 1950, the maulstick is telescopically constructed with both parts of the maulstick spring tensioned to draw the inner ends thereof towards each other, so that attachments on the outer ends can grip the sides of a work support, thereby freeing both hands. In U.S. Pat. No. 3,768,764, Oct. 30, 1973, the artist's hand support is a frame adapted to rest against a work support in which the frame includes a handle for supporting the frame. Accordingly, it is believed that none of the above prior art discloses a maulstick having all three features, namely, it can be adjusted for securement to sides of the work support, it can be locked at a predetermined length and it can be hung at one end to the work support.

SUMMARY OF THE INVENTION

It is therefore an object of the invention to provide an improved artist's maulstick that overcomes the disadvantages of the prior art maulsticks.

Another object of the present invention is to provide an artist's maulstick which permits the artist's brush wielding hand to be supported at a comfortable distance from the art work.

A further object of the present invention is to provide in an artist's maulstick means for locking it to the frame of the stretched canvas at a desired area thus leaving both hands of the artist free.

A still further object of the invention is to accomplish the foregoing objects in a simple, practical and economical manner.

Other and further objects will be obvious upon an understanding of the illustrative emdodiment about to be described, or will be indicated in the appended claims and various advantages not referred to herein will occur to one skilled in the art upon employment of the invention in practice.

In accordance with the present invention, the foregoing objects are generally accomplished by providing a telescopic maulstick that can be locked in an extended position and either affixed to the artist's work support or hung upon the work support, thereby enabling the artist to use the maulstick vertically, horizontally or at any desired angle.

BRIEF DESCRIPTION OF THE DRAWINGS

A preferred embodiment of the invention has been chosen for purposes of illustration and description and is shown in the accompanying drawings, forming a part of the specification, wherein:

Referring now to the drawings in detail, there is shown an artist's maulstick 10 for permitting an artist to perform detailed brush work with a supported steady hand on canvas 11 and the like. As shown in FIG. 1, the maulstick 10 is secured vertically to a frame 12 carrying the canvas 11 and in FIG. 2 horizontally. In FIG. 3 the maulstick 10 is shown freely disposed upon a work table 13, while in FIG. 4 one end of the maulstick 10 is freely disposed at the top of the frame 12 and and in FIG. 5 one end of the maulstick 10 is pivotally disposed at the top of the frame 12 while the other end thereof is manually held. It is thus evident in FIGS. 1 to 5 that the maulstick 10 of this invention affords an artist flexibility of movement and steadiness of his hand in performing his art.

Referring now to FIGS. 6–10, the maulstick 10 comprises two telescopic members 14 and 16, member 16 being slidable in member 14. Both members are preferably of light aluminum material in which member 14 is of "C" channel shape having inturned legs 17 for providing a guideway for channel member 16. To the left end of member 14, as viewed in FIG. 6, is attached, as by screws 18, a depending end member 19 preferably of plastic material such as, styrene, clear holes (not shown) being provided in member 14 and threads (not shown) in member 19 for threading the screws 18, one at each side, thereinto. As shown, end member 19 is for abutting engagement with a side edge of the artist's frame 12 and to assure that the bottoms of members 14 and 16 are elevated above the canvas 11 a shoulder 21 is incorporated therein, which shoulder rests upon the upper edge of the frame 12 with a side portion 22 thereof abutting the side of frame 12. Similarly at the other end of the maulstick 10, that is, at the right end of member 16, as viewed in FIG. 6, is provided a depending end member 23, also preferably of styrene material, secured by screws 24 to the member 16 and having a shoulder 26 and side portion 27.

Referring particularly to FIGS. 9 and 10, the right end member 23 is shown provided with a thumb screw assembly 28 for locking the maulstick 10 to the canvas frame 12 at a desired location in order to permit freedom of operation of both hands of the artist. The assembly 28 comprises three elements, a machine screw 29 with a knurled head 31 and threaded shank 32, a "U" shaped element 33 and a compression spring 34. As seen in FIG. 10, the right arm 36 of element 33 is provided with a clear hole 37 for passage therethrough of the screw shank 32 and the end member 23 is provided with a threaded opening 38 for mesh engagement with the threaded screw shank 32. It can be readily seen that, as the knurled head 31 of screw 29 is turned clockwise, the "U" shaped member 33 is moved to the left, as viewed in FIG. 10, so that the right arm 36 thereof compresses the spring 34 against the side of the end member 23 and the left arm 39 is urged against the canvas frame 12 (not shown). Upon retraction of the screw 29 the "U" shaped element 33 moves to the right, as viewed in FIG. 10, under influence of the spring 34 and the left arm 39 seats itself in a recess 41 provided in the end member 23, thereby freeing the maulstick 10 from the canvas frame 12.

Figure 1:
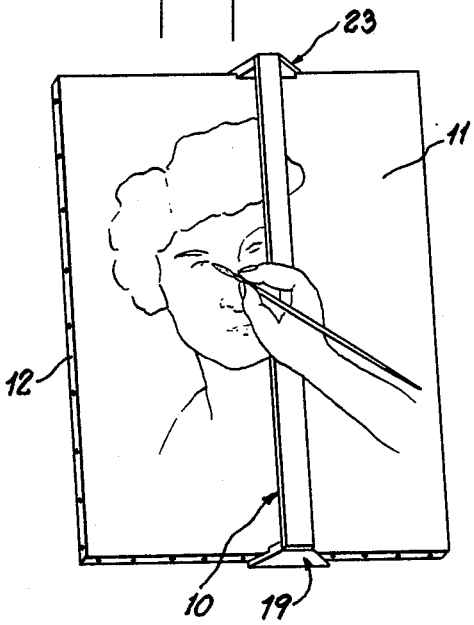
FIG. 1 is a perspective view showing the maulstick fastened to the canvas frame in a vertical position.
Figure 2:
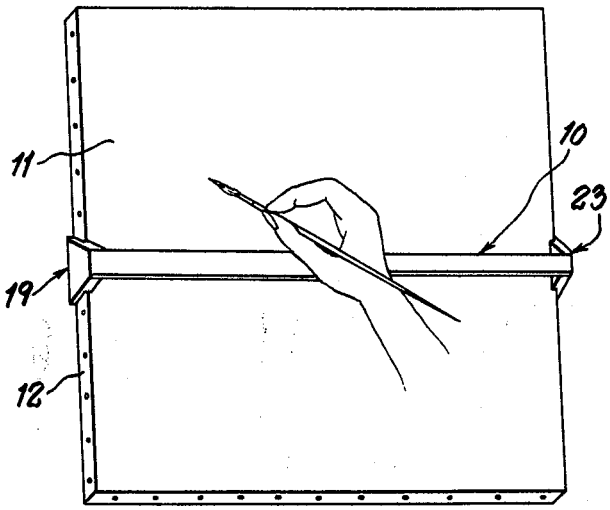
FIG. 2 is a perspective view showing the maulstick fastened to the canvas frame in a horizontal position.
Figure 3:
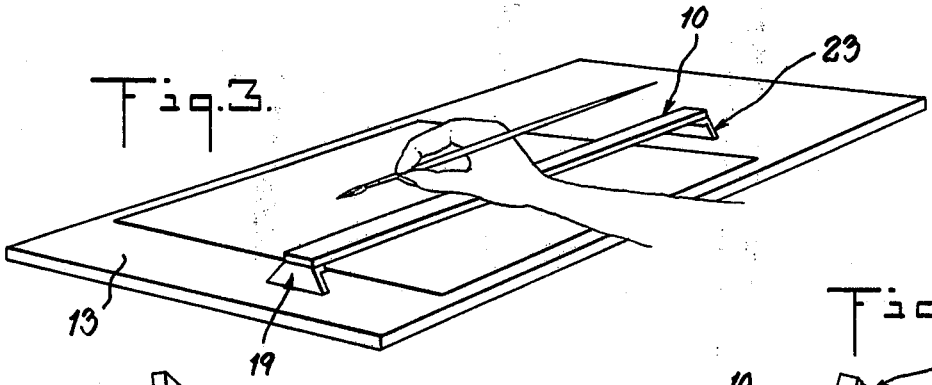
FIG. 3 is a perspective view showing the maulstick positioned freely on a supporting surface for the artist's work piece.
Figure 4:
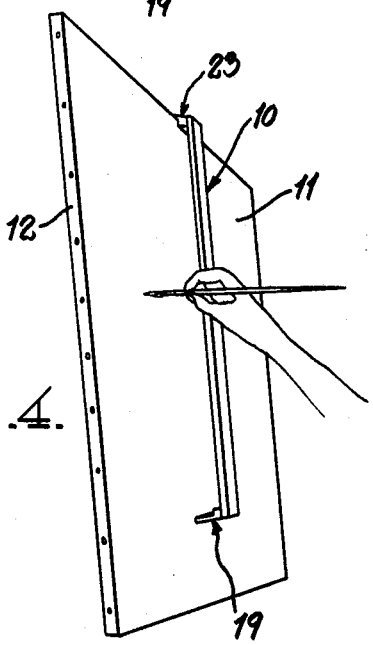
FIG. 4 is a perspective view showing the maulstick hung from the top of an artist's canvas frame.
Figure 5:
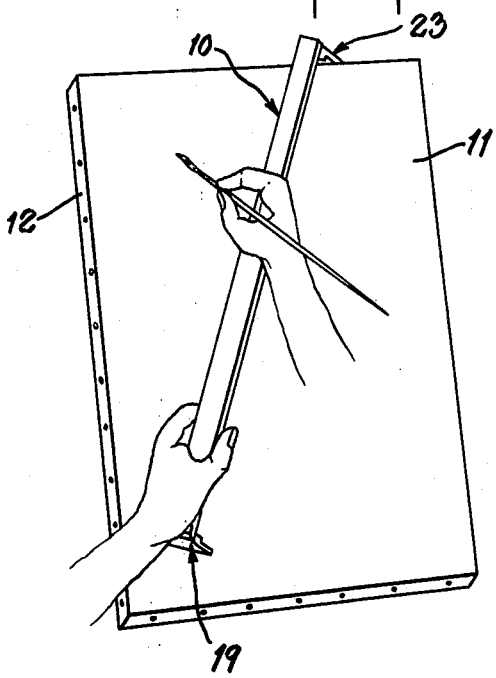
FIG. 5 is a perspective view showing the maulstick with one end engaging the top of the canvas frame and the other end held by the artist's left hand at a desired distance from the canvas while the artist's right hand rests intermediate the ends.

Since the members 14 and 16 are slidable with respect to each other, means are provided for securing them together, as required, in accordance with the dimensions of the canvas frame 12 to which the members are fastened. Such means are shown particularly in FIG. 7, wherein adjacent the inner end 42 of member 14 a threaded nut 43 is secured, as by welding, to the outer surface of a flange 44 of member 14, over a clear hole 45 in the flange 44, and a machine screw 46 with a knurled head 47 placed in mesh engagement with the nut 43. Clockwise rotation of the screw 46 will exert pressure against member 16 and lock both members.

Figures 6, 7, 8, 9, 10:
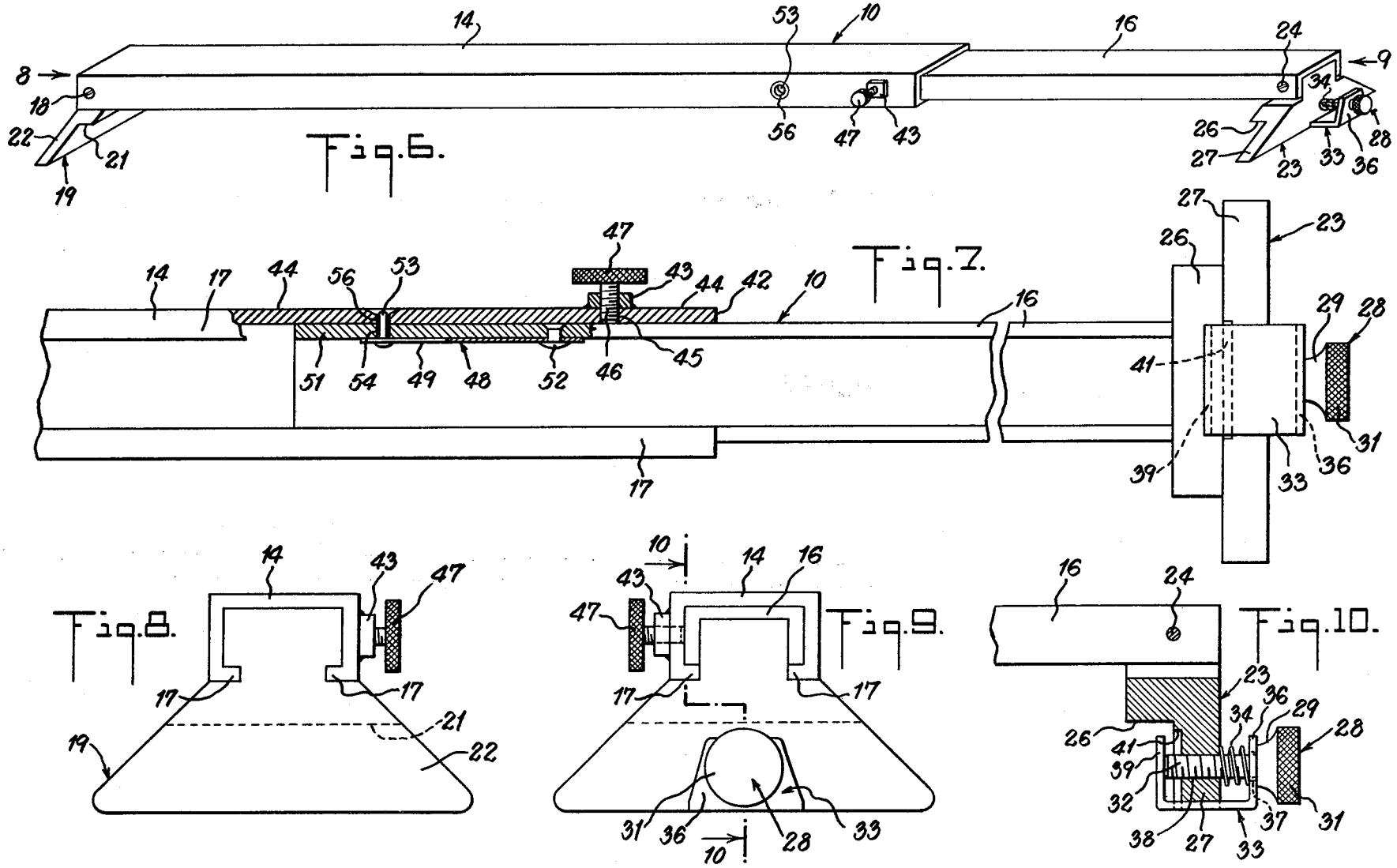
FIG. 6 is an isometric view of the maulstick.
FIG. 7 is a partial bottom plan view, partly broken away, of the maulstick showing the spring lock for preventing over extension of the maulstick, length adjusting means and canvas frame fastening means.
FIGS. 8 and 9 are end elevation views taken in the direction of the arrows 8 and 9 in FIG. 6.
FIG. 10 is a partial sectional view taken along the line 10—10 of FIG. 9 showing the means for clamping one end of the maulstick to the canvas frame.

As indicated also in FIG. 7, a detent arrangement 48 is provided for preventing the members 14 and 16 from separating from each other when being extended. Such detent 48 includes a leaf spring 49 secured at one end to the inner surface of a flange 51 of the member 16 by a rivet 52. The other end of the leaf spring 49 is provided with a detent button 53 that projects through openings 54 and 56 in flanges 51 and 44, respectively, opening 56 being preferably chamfered for ease in finger pressing the button 53 for disengagement of the members. As shown in FIG. 7, the detent button 53 is in registry with the openings 54 and 56, whereby the maulstick 10 is at its maximum length. In view of the limitless sizes of canvas and art work maulsticks 10 of this invention can be manufactured in several lengths, such as, 3 ft., 4 ft., and 5 ft. Since the maulstick 10 can be made of light aluminum and styrene, it is comparatively light in weight and readily manipulated.

As various changes may be made in the form, construction, and arragmment of the parts herein, without departing from the spirit and scope of the invention and without sacrificing any of its advantages, it is to be understood that all matters are to be interpreted as illustrative and not in any limiting sense.

What is claimed is:

1. An artist's maulstick comprising, in combination, a pair of channel like members, an outer one and an inner one slidable longitudinally with respect to the other in which the outer channel member includes inturned arms for embracing the inner channel member, a depending bracket at each end of said members, means for locking said members at predetermined lengths thereof, means for preventing separation of said members during extension thereof, said depending bracket at one end of said outer member including a flange for engagement with a side of a support on which the maulstick is to be mounted, a shoulder on said bracket adapted to rest upon the support for elevating the maulstick above the surface of the support, means for securing said bracket to one end of said channel members, said depending bracket at the other end of said channel members including a flange for engagement with an opposite side of said support on which the maulstick is to be mounted, a shoulder on said second bracket adapted to rest upon the support for elevating the maulstick above the surface of the support, means for clamping said maulstick to the sides of the support, means for securing said bracket to an other end of said members, said clamping means including a thumb screw threadedly carried by said flange, wherein a shank of said screw extends through said flange and its free end is adapted to engage the side of the support, said clamping means further including a "U" shaped member having a clear opening in one of its legs for passage of said screw shank therethrough, said "U" shaped member straddling said flange and movable longitudinally under influence of the thumb screw, said one leg of said "U" shaped member being disposed on an outer side of said flange contiguous to a head of said thumb screw and the other leg of said "U" shaped member being disposed on the inner side of said flange for engagement with the side of the support by impression of the end of the screw, a resilient element being interposed between said one leg and a side of said flange for retracting the "U" shaped member as the thumb screw is unthreaded, and said flange on its inner surface having a recess into which said one leg is received upon retraction by the thumb screw of the "U" shaped member.

* * * * *